US009488177B2

(12) United States Patent
Kim

(10) Patent No.: US 9,488,177 B2
(45) Date of Patent: Nov. 8, 2016

(54) WATER PUMP

(71) Applicant: AMOTECH CO., LTD., Incheon (KR)

(72) Inventor: Byung Soo Kim, Anyang-si (KR)

(73) Assignee: AMOTECH CO., LTD. (KR)

( * ) Notice: Subject to any disclaimer, the term of this patent is extended or adjusted under 35 U.S.C. 154(b) by 0 days.

(21) Appl. No.: 14/589,144

(22) Filed: Jan. 5, 2015

(65) Prior Publication Data

US 2015/0110653 A1 Apr. 23, 2015

Related U.S. Application Data

(62) Division of application No. PCT/KR2013/004612, filed on May 27, 2013.

(30) Foreign Application Priority Data

Jun. 11, 2012 (KR) ..... 10-2012-0062153

(51) Int. Cl.

| | |
|---|---|
| ***F04D 13/06*** | (2006.01) |
| ***F04D 13/02*** | (2006.01) |
| *F04D 1/00* | (2006.01) |

(52) U.S. Cl.

CPC ..... *F04D 13/025* (2013.01); *F04D 13/026* (2013.01); *F04D 13/0606* (2013.01); *F04D 13/0673* (2013.01); *F04D 1/00* (2013.01)

(58) Field of Classification Search

CPC ..... F04D 13/025; F04D 13/026; F04D 13/0673; F04D 1/00; F04D 13/0606; F04D 13/0626; F04D 13/0613; F04D 29/044

See application file for complete search history.

(56) References Cited

U.S. PATENT DOCUMENTS

| | | | | |
|---|---|---|---|---|
| 4,277,115 | A | 7/1981 | Stuwe et al. | |
| 2004/0062664 | A1 | 4/2004 | Weigold et al. | |
| 2006/0045776 | A1* | 3/2006 | Kalavsky | F04D 13/0646 417/423.14 |
| 2007/0090704 | A1 | 4/2007 | Chen | |
| 2008/0118380 | A1* | 5/2008 | Nakanishi | F04D 13/064 417/423.1 |
| 2009/0155066 | A1* | 6/2009 | Komatsu | F04D 29/167 415/206 |
| 2010/0158725 | A1 | 6/2010 | Werson et al. | |

FOREIGN PATENT DOCUMENTS

| | | |
|---|---|---|
| JP | 2007002781 | 1/2007 |
| KR | 1020110127852 | 11/2011 |
| KR | 1020130138505 | 12/2013 |

OTHER PUBLICATIONS

International Search Report—PCT/KR2013/004612 dated Aug. 14, 2013.

* cited by examiner

*Primary Examiner* — Charles Freay
*Assistant Examiner* — Philip Stimpert
(74) *Attorney, Agent, or Firm* — Cantor Colburn LLP

(57) ABSTRACT

A water pump includes: a lower casing; a shaft fixed to the center of the lower casing; a stator disposed in the lower casing; an outer rotor that is arranged at a predetermined gap to the outer circumferential surface of the stator and is rotatably supported on the fixed shaft; an upper casing that is sealably mounted on an upper side of the lower casing in which an inlet and an outlet are formed; an impeller that is disposed in the upper casing and that is rotatably supported on the fixed shaft; and a power transmission unit that is installed between the impeller and the rotor and transmits the rotational force of the rotor to the impeller by a magnetic force, to prevent water from being introduced into thecasing, and to allow the fixed shaft to rotatably support the rotor, as well as to rotatably support the impeller.

11 Claims, 3 Drawing Sheets

WATER PUMP

CROSS REFERENCE TO RELATED APPLICATIONS

This application is a divisional of International Application No. PCT/KR2013/004612, filed on May 27, 2013, which claims priority to and the benefit of Korean Application No. 10-2012-0062153 filed on Jun. 11, 2012 in the Korean Patent Office, the entire contents of which are incorporated herein by reference.

TECHNICAL FIELD

The present invention relates to a water pump in which a gap between a drive unit and a pump unit is sealed, which can prevent water from being introduced into the drive unit.

BACKGROUND ART

In general, a water pump is installed in a drain water tank of a washing machine, or is used for circulation of a coolant that cools an engine.

The water pump includes: a drive unit for generating a driving force under a power-on situation; and a pump unit that is connected to the drive unit which pumps water. Since the water pump performs functions of pumping the water, the water flowing into the drive unit results in a failure of the drive unit. Accordingly, a pump with a mechanical seal structure or a canned pump having a canned cover structure of sealing a stator is used for the purpose of protecting the drive unit from the water.

Since U.S. Pat. No. 4,277,115 that proposed a canned pump employs a structure in which a canned cover seals only a stator, a rotor is sunk in water, to thus adversely affect the durability of bearings supporting a rotating shaft. In addition, a magnetic gap cannot be optimally maintained due to a canned cover disposed between the rotor and the stator, to thus cause a problem of falling efficiency.

In addition, in the case of the canned pump, since the rotor is sunk into water, the rotation of the rotor is affected and the motor efficiency is lowered.

SUMMARY OF THE INVENTION

To solve the above problems or defects, it is an object of the present invention to provide a water pump that prevents water being introduced into a pump unit from being leaked into a drive unit by partitioning the pump unit in which an impeller is mounted and the drive unit in which a motor is mounted, and that transmits the rotational force of the drive unit to the impeller by using a magnetic force.

It is another object of the present invention to provide a water pump that allows a fixed shaft to rotatably support a rotor, as well as to rotatably support an impeller, to thereby match the axial center and facilitate the easy assembly.

It is a still another object of the present invention to provide a water pump that employs an outer rotor type in which a rotor magnet is disposed on the outer circumferential surface of a stator, to thereby increase an effective area between the rotor magnet and a stator core and to thus improve performance, and that applies a relatively cheap ferrite-based material as the rotor magnet.

It is a further object of the present invention to provide a water pump in which a fixed shaft is integrally formed on a lower casing by insert-molding to thereby block water inflow fundamentally.

The objects of the present invention are not limited to the above-described objects, and other objects and advantages of the present invention can be appreciated by the following description and will be understood more clearly by embodiments of the present invention. In addition, it will be appreciated that the objects and advantages of the present invention will be easily realized by means shown in the appended patent claims, and combinations thereof.

To accomplish the above and other objects of the present invention, according to an aspect of the present invention, there is provided a water pump comprising: a lower casing; a fixed shaft fixed to the center of the lower casing; a stator disposed in the lower casing; an outer rotor that is arranged at a predetermined gap to the outer circumferential surface of the stator and is rotatably supported on the fixed shaft; an upper casing that is sealably mounted on an upper side of the lower casing in which an inlet and an outlet are formed; an impeller that is disposed in the upper casing and that is rotatably supported on the fixed shaft; and a power transmission unit that is installed between the impeller and the rotor and transmits the rotational force of the rotor to the impeller by a magnetic force.

As described above, the water pump according to the present invention includes a pump unit in which an impeller is mounted and a drive unit in which a motor is mounted, wherein the pump unit and the drive unit are mechanically partitioned from each other, to thereby prevent water being introduced into the pump unit from being leaked into the drive unit and includes a power transmission unit that is formed between the impeller and a rotor and transmits the rotational force of the drive unit to the impeller by using a magnetic force.

In addition, the water pump according to the present invention allows a fixed shaft to rotatably support a rotor, as well as to rotatably support an impeller, to thereby match the axial center and simplify the easy assembly.

In addition, the water pump according to the present invention employs an outer rotor type in which a rotor magnet is disposed on the outer circumferential surface of a stator, to thereby increase an effective area between the rotor magnet and a stator core and to thus improve performance, and advantageously applies a relatively cheap ferrite-based material as the rotor magnet.

In addition, the water pump according to the present invention employs a fixed shaft that is integrally formed on a lower casing by insert-molding to thereby block water inflow fundamentally.

DETAILED DESCRIPTION OF THE INVENTION

Figure 1:
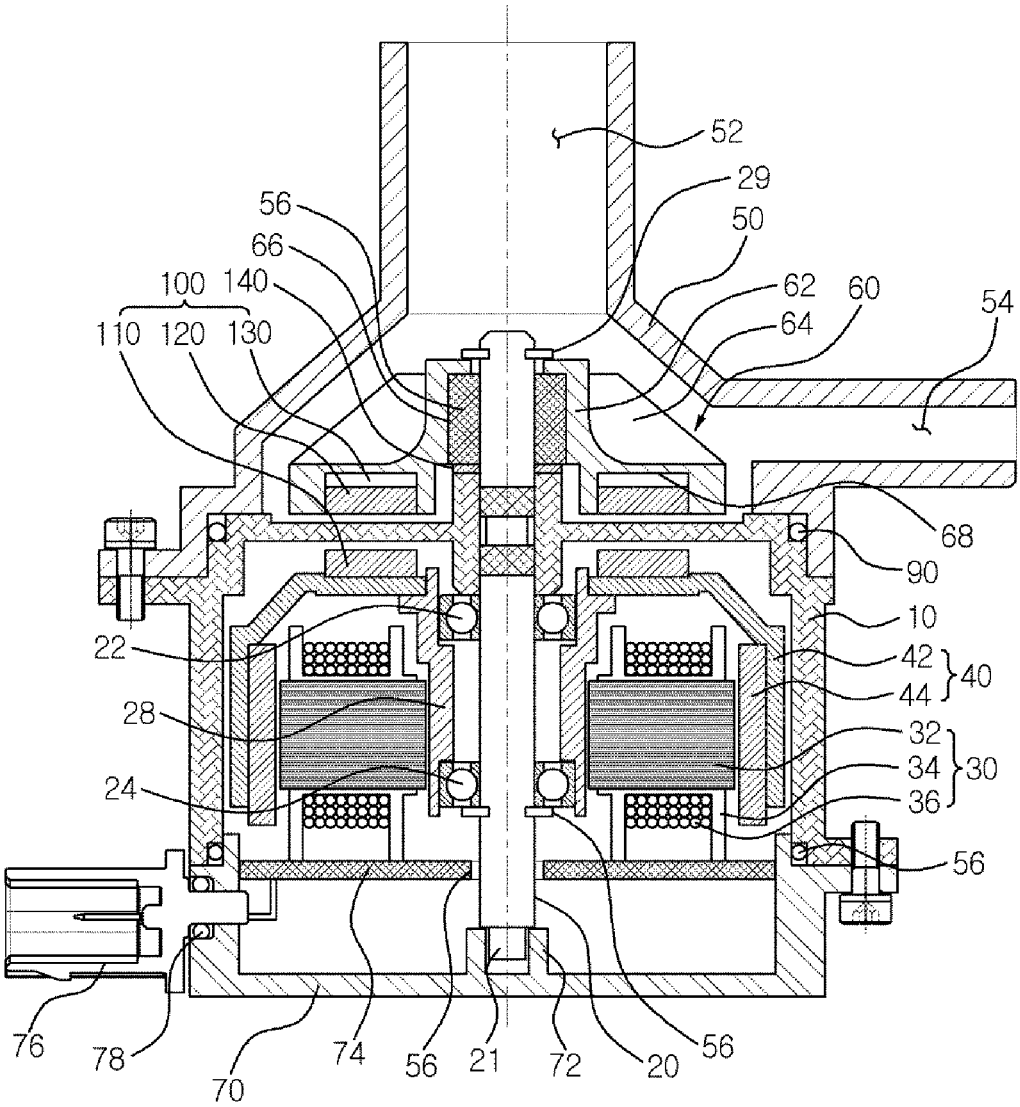
FIG. 1 is a transverse cross-sectional view showing a water pump according to an embodiment of the present invention.

Hereinafter, a water pump according to preferred embodiments of the present invention will be described in detail with reference to the accompanying drawings, respectively. In this process, the size and shape of the components shown in the drawings may be exaggerated for convenience and clarity of explanation. In addition, specially defined terms according to the structure and operation of the present invention, can vary depending on intention or custom of a user or operator. The definition of the terms should be made on the basis of the content throughout the present specification.

Figure 2:
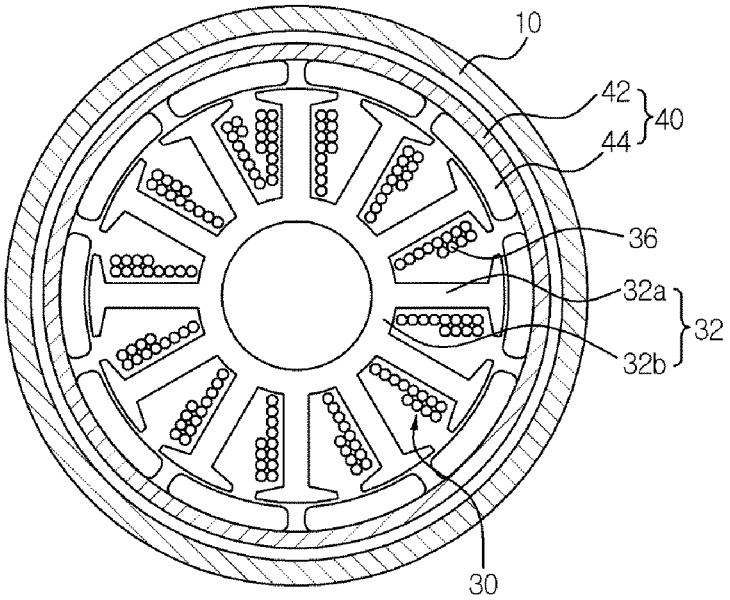
FIG. 2 is a longitudinal cross-sectional view of a water pump according to an embodiment of the present invention.

FIG. 1 is a transverse cross-sectional view showing a water pump according to an embodiment of the present invention, and FIG. 2 is a longitudinal cross-sectional view of a water pump according to an embodiment of the present invention.

Referring to FIGS. 1 and 2, a water pump in accordance with one embodiment of the present invention includes: a lower casing 10; a fixed shaft 20 fixed to the center of the lower casing 10; a stator 30 disposed in the lower casing 10; an outer rotor 40 that is arranged at a predetermined gap to the outer circumferential surface of the stator 30 and is rotatably supported on the fixed shaft 20; an upper casing 50 that is sealably mounted on an upper side of the lower casing 10 in which an inlet 52 through which water is introduced and an outlet 54 through which a pumped water is discharged are formed; an impeller 60 that is disposed in the upper casing 50 and that is rotatably supported on the fixed shaft 20; and a power transmission unit 100 that is installed between the impeller 60 and the rotor 40 and transmits the rotational force of the rotor 40 to the impeller 60 by a magnetic force.

The fixed shaft 20 is sealably fixed to the upper surface of the lower casing 10, and a cover member 70 is sealably mounted on the opened lower surface of the lower casing 10.

Figure 3:
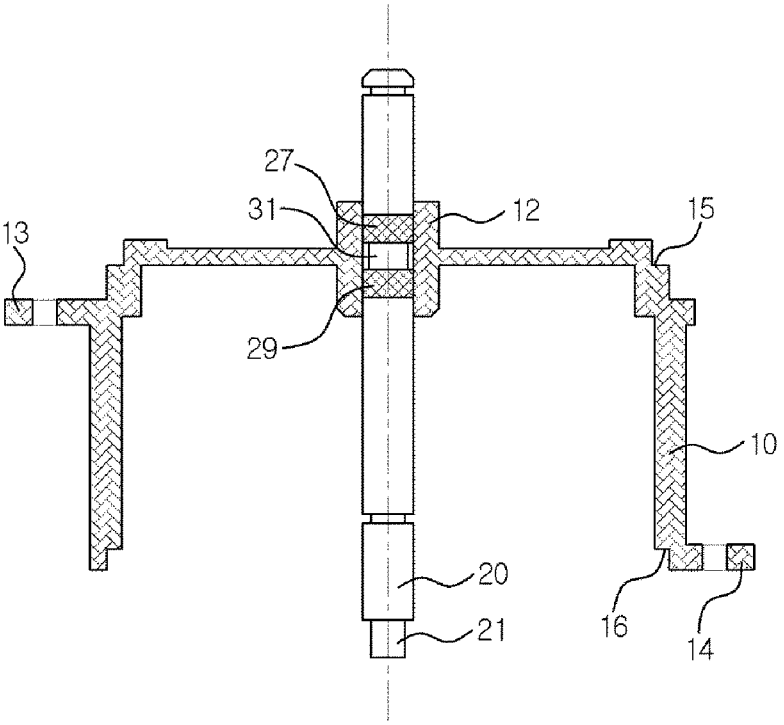
FIG. 3 is a cross-sectional view of a lower casing according to an embodiment of the present invention.

As shown in FIG. 3, a shaft fixing unit 12 to which the fixed shaft 20 is fixed is formed at the center of the upper surface of the lower casing 10, a plurality of first flanges 13 for fastening the upper casing 50 with bolts are formed on the outer circumferential surface of the upper side of the lower casing 10, and a plurality of second flanges 14 for fastening the cover member 70 with bolts are formed on the outer circumferential surface of the lower side of the lower casing 10.

A first ring mount groove 15 is formed on the outer side of the upper surface of the lower casing 10 in which a first seal ring 90 for maintaining air-tightness with respect to the lower casing 10 is mounted in the first ring mount groove 15, and a second ring mount groove 16 is formed on the inner side of the lower surface of the lower casing 10 in which a second seal ring 92 for maintaining air-tightness with respect to the cover member 70 is mounted in the second ring mount groove 16.

Since the lower casing 10 that is formed in this way is formed integrally with the fixed shaft 20 by insert-molding of the fixed shaft 20, a leak between the fixed shaft 20 and the lower casing 10 can be blocked inherently.

The cover member 70 is sealably fastened on the opened lower surface of the lower casing 10, and a fitting groove 72 is formed on the center of the inner surface of the cover member 70 in which the lower end of the fixed shaft 20 is fitted into the fitting groove 72.

Since the rotor 40 is rotatably supported on the outer circumferential surface of the lower side of the fixed shaft 20, and the impeller 60 is rotatably supported on the outer circumferential surface of the upper side of the fixed shaft 20, the fixed shaft 20 is subjected to receive a force continuously both in the radial direction and in the lateral direction during rotation of the rotor 40, and should not be moved both in the radial direction and in the lateral direction by the force exerted by the rotor 40.

Further, the fixed shaft 20 is subjected to receive the same force as that of during rotation of the rotor 40, during rotation of the impeller 60, and the impeller 60 is caused to oscillate in the vertical direction due to the water inflow. The fixed shaft 20 is subjected to receive the force according to the vertical movement of the impeller 60.

Thus, the fixed shaft 20 is to be fixedly secured to prevent the movement both in the lateral direction and in the vertical direction. For this purpose, scratch portions 27 and 29 that are formed in a net shape are formed on the outer circumferential surface of the fixed shaft 20. When the fixed shaft 20 is insert-molded with the lower casing 10, a bonding force between the fixed shaft 20 and the lower casing 10 increases. A concave ring groove 31 is formed in the circumferential direction of the fixed shaft 20. When the fixed shaft 20 is insert-molded with the lower casing 10, the lower casing 10 is inserted into the concave ring groove 31, to thus prevent the vertical movement of the fixed shaft 20.

In addition, a fitting protrusion 21 whose outer diameter is smaller is formed on the lower end of the fixed shaft 20 and the fitting protrusion 21 is fitted into the fitting groove 72 of the cover member 70 in a tight fit manner, to thus suppress the vertical movement of the fixed shaft 20.

As described above, the fixed shaft 20 is formed to have the scratch portions 27 and 29 and the concave ring groove 31 at portions where the fixed shaft 20 is insert-molded with the outer circumferential surface of the upper side of the lower casing 10, to thus strengthen the bonding force between the lower casing 10 and the fixed shaft 20. The fitting protrusion 21 is formed at the lower end of the fixed shaft 20 and thus is tightly fitted into the fitting groove 72 of the cover member 70, to thus prevent both the lateral and vertical movements of the fixed shaft 20, and to thereby prevent the movement of the fixed shaft 20 during rotation of the rotor 40 and the impeller 60.

Then, a printed circuit board 74 is mounted on the inner surface of the cover member 70 in which various circuit components are mounted on the printed circuit board 74, and a terminal 76 is mounted on the outer surface of the cover member 70 in which an external power source is connected with the terminal 76. Here, the terminal 76 is electrically connected with the printed circuit board 74.

A through-hole 56 is formed at the center of the printed circuit board 74 in which the fixed shaft 20 passes through the through-hole 56, and the outer edge of the printed circuit board 74 is coupled with the cover member 70 with bolts.

Here, the terminal 76 is integrally formed with the cover member 70 by insert-molding of the side of the cover member 70, and a third sealing ring 78 for maintaining air-tightness between the cover member 70 and the terminal 76 is mounted between the cover member 70 and the terminal 76.

The stator 30 includes: a stator core 32 around which a plurality of T-shaped portions 32*a* are arranged in the radial direction of the stator core 32; a bobbin 34 made of an insulating material and that is enclosed on the outer surface of each of the T-shaped portions 32*a* of the stator core 32; and a coil 36 wound on the outer surface of the bobbin 34.

The stator core 32 includes: a circular ring-shaped body portion 32*b*; and the T-shaped portions 32*a* that are radially formed at a predetermined interval on the outer circumferential surface of the body portion 32*b* and are disposed facing magnets 44 of a rotor 40.

The bobbin 34 is integrally formed on the outer circumferential surface of the stator core 32 by insert-molding of the bobbin 34, and extends downwards so as to be fixed on the printed circuit board 74. That is, the stator 30 has a structure that the bobbins 34 are radially fixed on the printed circuit board 74 so that the stator 30 is fixed on the printed circuit board 74.

Figure 4:
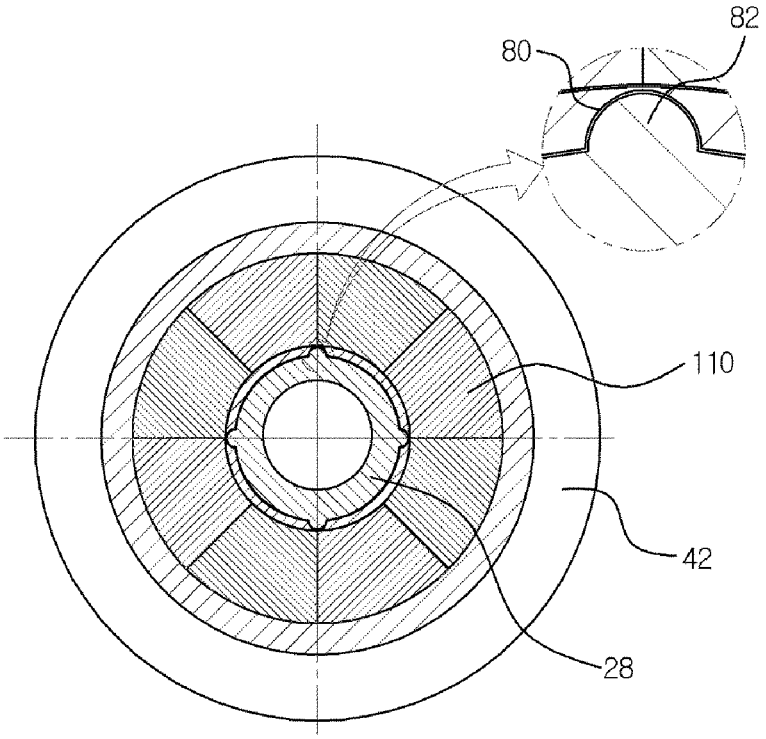
FIG. 4 is a cross-sectional view of a rotor according to an embodiment of the present invention.
Figure 5:
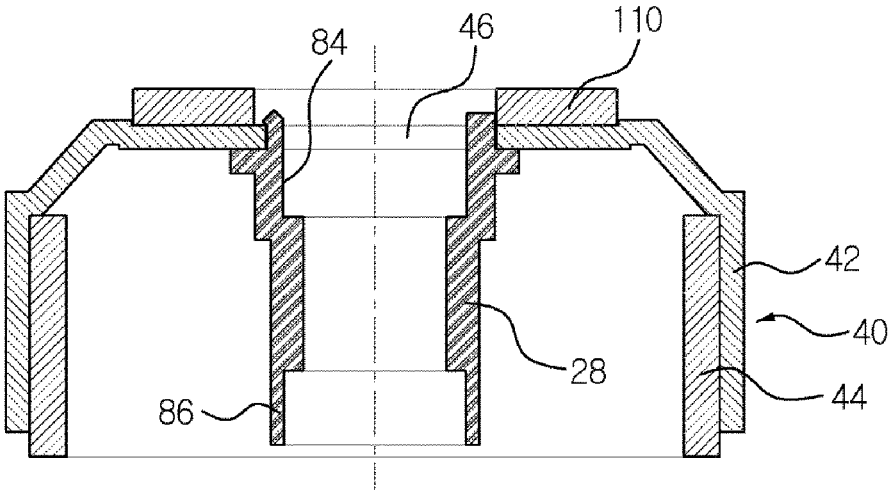
FIG. 5 is a plan view of a rotor according to an embodiment of the present invention.

FIG. 4 is a cross-sectional view of a rotor according to an embodiment of the present invention, and FIG. 5 is a plan view of a rotor according to an embodiment of the present invention.

The outer rotor 40 includes: a rotor support 42 that is rotatably supported on the outer circumferential surface of the fixed shaft 20; and a plurality of the rotor magnets 44 that are mounted on the inner surface of the rotor support 42, and that are disposed at a predetermined gap on the outer circumferential surface of the stator 30, in which N poles and S poles are alternately arranged.

In this way, since this embodiment employs an outer rotor type in which the rotor magnets 44 are disposed on the outer circumferential surface of the stator 30, an effective area between each of the rotor magnets 44 and the stator core 32 can be increased, to thereby improve the performance of the motor. Further, since the effective area between each of the rotor magnets 44 and the stator core 32 is large, a relatively cheap ferrite-based magnet may be used.

A bushing 28 is rotatably supported on the outer circumferential surface of the fixed shaft 20, and one side of the bushing 28 is connected to the rotor support 42.

A through-hole 46 is formed on the upper surface of the rotor support 42 in which the fixed shaft 20 passes through the through-hole 46, and the outer circumferential surface of the bushing 28 is rotatably coupled on the inner surface of the through-hole 46. That is, a plurality of engagement grooves 80 are formed at a predetermined interval in the circumferential direction of the bushing 28 on the inner circumferential surface of the through-hole 46, and a plurality of engagement protrusions 82 are formed on the outer circumferential surface of the upper side of the bushing 28, in which the engagement protrusions 82 are inserted into and engaged with the engagement grooves 80, respectively.

Thus, since the rotor support 42 and the bushing 28 are coupled with each other by engagement between the engagement grooves 80 and the engagement protrusions 82, the rotor support 42 and the bushing 28 are rotated together, and the rotor 40 is rotatably supported on the fixed shaft 20.

A the first bearing 22 and a second bearing 24 are mounted between the bushing 28 and the fixed shaft 20, and thus the bushing 28 is rotatably supported on the outer circumferential surface of the fixed shaft 20. It is possible to use oil-type ball bearings with no waterproof structure as the first bearing 22 and the second bearing 24. Therefore, the oil-type ball bearings are also of high durability when compared with oil-less bearings. Of course, it is also possible to use the oil-less bearings as the first bearing 22 and the second bearing 24.

The bushing 28 is formed in a cylindrical shape, in which a first bearing mounting portion 84 is formed on the inner surface of the upper side of the bushing 28, in which the first bearing mounting portion 84 is formed in a groove shape so that the first bearing 22 is mounted into the first bearing mounting portion 84, and a second bearing mounting portion 86 is formed on the inner surface of the lower side of the bushing 28, in which the second bearing mounting portion 86 is formed in a groove shape so that the second bearing 24 is mounted into the second bearing mounting portion 86.

In addition, a secession prevention ring 26 is mounted on the outer circumferential surface of the fixed shaft 20, to thus prevent the second bearing 24 and the bushing 28 from being seceded from the fixed shaft 20.

The upper casing 50 is bolted on the upper surface of the lower casing 10, in which an inlet 52 through which water flows in is formed on the upper side of the upper casing 50, and an outlet 54 through which water flows out is formed on the lateral side of the upper casing 50, in which water pumped by the impeller 60 is discharged through the outlet 54. The first seal ring 90 is mounted between the upper casing 50 and the lower casing 10, to thus prevent water from being leaked to the outside of the lower casing 50.

The impeller 60 includes: a body portion 62 which is rotatably supported by the fixed shaft 20; and a blade portion 64 formed integrally on the outer circumferential surface of the body portion 62. Then, a bearing mounting groove 66 is formed on the inner surface of the body portion 62 in which a third bearing 25 is mounted in the bearing mounting groove 66, and a magnet mounting groove 68 is formed on the lower surface of the body portion 62 in which a back yoke 130 and a second magnet 120 of the power transmission unit 100 are mounted in the magnet mounting groove 68.

The third bearing 25 is preferably formed in a cylindrical shape, and employs a bearing such as a carbon bearing or a plastic bearing, in consideration of being in a contact with water.

In addition, a secession prevention ring 29 is mounted on the outer circumferential surface of the fixed shaft 20, to thus prevent the impeller 60 from being seceded from the fixed shaft 20.

An anti-friction sheet 140 is mounted between the lower surface of the third bearing 25 and the upper surface of a shaft fixing portion 12 formed on the lower casing 10, in which the anti-friction sheet 140 prevents friction between the third bearing 25 and the lower casing 10 during rotation of the impeller 60.

Here, the shaft fixing portion 12 is formed in a cylindrical shape in which the upper surface of the shaft fixing portion 12 contacts the third bearing 25, and the lower surface of the shaft fixing portion 12 contacts the first bearing 22. That is, since the shaft fixing portion 12 plays a role of supporting the lower surface of the third bearing 25 as well as supporting the upper surface of the first bearing 22, it is advantageous that a separate structure for supporting the lower surface of the third bearing 25 as well as the upper surface of the first bearing 22 is not required and an assembly is facilitated.

The power transmission unit 100 includes: a first magnet 110 which is fixed in the circumferential direction of the rotor support 42 on the upper surface of the rotor support 42; a second magnet 120 that is disposed in opposition to the first magnet 110 and that is fixed in the circumferential direction of the impeller 60; and a back yoke 130 that is mounted on the rear surface of the second magnet 120 to form a magnetic circuit. In addition, since the rotor support 42 on which the first magnet 110 is mounted is formed of a metallic material that can be served as the back yoke, a separate back yoke is not required.

The first magnet 110 and the second magnet 120 are disposed so that N poles and S poles are alternately arranged in a radial direction, respectively, and are disposed to have opposite polarities facing each other to thereby act a mutual attraction force on each other.

Here, since the first magnet 110 and the second magnet 120 have a structure so that N poles and S poles are alternately arranged, a slip occurring between the first magnet 110 and the second magnet 120 can be minimized.

The operation of the water pump in accordance with one embodiment of the present invention that is configured in this way, will be described below as follows.

When the stator 30 is powered through the terminal 76, the rotor 40 is rotated by the interaction of the stator 30 and the rotor 40.

Then, the first magnet 110 fixed on the top surface of the rotor support 42 is rotated. Then, since the second magnet 120 that is mounted on the lower side of the impeller 60 is mutually attracted with respect to the first magnet 110, the magnet 120 is rotated. Accordingly, the impeller 60 is rotated to thus pump the water flowing in through the inlet 52 and discharge the pumped water to the outside of the outlet 54.

In this case, since a gap between the upper casing 50 in which the impeller 60 is mounted and the lower casing 10 in which the rotor 40 and the stator 30 are built, is mechanically blocked, the water from flowing into the upper casing 50 is prevented from being introduced into the lower casing 10.

In addition, the fixed shaft 20 is insert-molded with the lower casing 10, to thus prevent the water from leaking between the fixed shaft 20 and the lower casing 10.

Since the fixed shaft 20 rotatably supports the impeller 60 and the rotor 40, and thus is urged to receive a force both in the lateral direction and in the vertical direction, the scratch portions 27 and 29 and the ring groove 31 are formed on the outer circumference of the upper side of the fixed shaft 20, to thereby increase a bonding force when insert-molding of the lower casing 10 and prevent the vertical movement of the fixed shaft 20.

In addition, the fitting protrusion 21 is formed on the lower side the fixed shaft 20, and thus is fitted into the fitting groove 72 formed in the cover member 70 to thereby prevent the vertical movement of the fixed shaft 20.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

A water pump according to the present invention is installed in a drain water tank of a washing machine, or is used for circulation of a coolant that cools an engine. The present invention can be applied to various technical fields of water pumps since a pump unit in which an impeller is mounted is separated from a drive unit in which a motor is mounted, so that water that is introduced into the pump unit is prevented from being leaking to the drive unit.

What is claimed are:

1. A water pump comprising:

a lower casing;

an upper casing sealably mounted on an upper side of the lower casing, the upper casing including a water inlet and a water outlet;

a fixed shaft fixed to a center of the lower casing by a shaft fixing unit, the lower casing and the fixed shaft being integrally formed with each other, the fixed shaft penetrating the center of the lower casing and protruding inside the lower casing and inside the upper casing;

a stator disposed inside the lower casing;

an outer rotor that is arranged at a predetermined gap to an outer circumferential surface of the stator and is rotatably supported on the fixed shaft;

an impeller that is disposed inside the upper casing and that is rotatably supported on the fixed shaft; and a power transmission unit that is installed between the impeller and the rotor and transmits rotational force of the rotor to the impeller by a magnetic force, wherein the shaft fixing unit includes a concave ring groove formed around an outer circumferential surface of the fixed shaft, and scratches formed at a plurality of portions where the fixed shaft contacts the lower casing during the insert-molding of the fixed shaft, thereby reinforcing a bonding force, preventing a vertical movement of the fixed shaft and sealing the lower casing, wherein a first one of the portions is formed above the contact ring groove and a second one of the portions is formed below the contact ring groove.

2. The water pump of claim 1, wherein a cover member is sealably mounted on an opened lower surface of the lower casing, a printed circuit board is mounted inside the cover member, and a terminal is mounted outside the cover member, wherein the terminal is integrally formed with the cover member by an insert-molding.

3. The water pump of claim 1, wherein a cover member is sealably mounted on an opened lower surface of the lower casing, and a fitting groove is formed in an inner surface of the cover member, and wherein a fitting protrusion is formed in a lower end of the fixed shaft and fitted into the fitting groove.

4. The water pump of claim 1, wherein the stator comprises: a stator core; a bobbin made of an insulating material and enclosed on an outer surface of the stator core; and a coil wound on an outer surface of the bobbin, and a lower end of the bobbin is mounted in a circumferential direction on the printed circuit board.

5. The water pump of claim 4, wherein the stator core comprises: a circular ring-shaped body portion; and a plurality of T-shaped portions that are radially formed at a predetermined interval on an outer circumferential surface of the body portion and around which the coil is wound, respectively.

6. The water pump of claim 1, wherein the outer rotor comprises: a rotor support that is rotatably supported on the fixed shaft; and a plurality of rotor magnets that are mounted on an inner surface of the rotor support, and disposed at the predetermined gap to the outer circumferential surface of the stator, N poles and S poles of the rotor magnets being alternately arranged, and wherein a bushing is rotatably supported on the outer circumferential surface of the fixed shaft, and the bushing is connected to the rotor support.

7. The water pump of claim 6, wherein a through-hole is formed on the upper surface of the rotor support, the fixed shaft passing through the through-hole, a plurality of engagement grooves are formed in the circumferential direction on an inner circumferential surface of the through-hole, and a plurality of engagement protrusions are formed on an outer circumferential surface of the upper side of the bushing, the engagement protrusions being engaged with the engagement grooves, respectively.

8. The water pump of claim 6, wherein a first bearing and a second bearing are mounted on an inner surface of the bushing, the second bearing is engaged with a secession prevention ring that is mounted on an outer surface of a lower side of the fixed shaft, to thereby prevent the second bearing from being seceded from the fixed shaft, and the first bearing is in contact with a lower surface of the shaft fixing unit.

9. The water pump of claim 1, wherein a bearing is mounted on an inner surface of the impeller, and an anti-friction sheet is mounted between the bearing and an upper surface of the shaft fixing unit.

10. The water pump of claim 9, wherein a secession prevention ring is mounted on an upper side of the third bearing, to thus prevent the impeller from being seceded from the fixed shaft.

11. The water pump of claim 1, wherein the power transmission unit comprises: a first magnet which is fixed on an upper surface of the rotor support of the outer rotor; and a second magnet that is disposed in opposition to the first magnet and that is fixed on a lower surface of the impeller, and wherein the first magnet and the second magnet are disposed so that N poles and S poles are alternately arranged in a radial direction, respectively, and are disposed to have opposite polarities facing each other.

* * * * *